United States Patent [19]

Collonia

[11] Patent Number: 4,599,980

[45] Date of Patent: Jul. 15, 1986

[54] ELECTRIC DEVICE FOR ELIMINATING THE JERKING OF VEHICLES

[75] Inventor: Harald Collonia, Glashütten, Fed. Rep. of Germany

[73] Assignee: VDO Adolf Schindling AG, Frankfurt am Main, Fed. Rep. of Germany

[21] Appl. No.: 551,639

[22] Filed: Nov. 14, 1983

[30] Foreign Application Priority Data

Nov. 18, 1982 [DE] Fed. Rep. of Germany ..... 3242483

[51] Int. Cl.[4] ..... F02M 3/07; F02M 7/12

[52] U.S. Cl. ..... 123/339; 123/436; 123/585

[58] Field of Search ..... 123/436, 585, 339

[56] References Cited

U.S. PATENT DOCUMENTS 4,291,656 9/1981 Miyagi et al. ..... 123/339 X

FOREIGN PATENT DOCUMENTS 2823848 12/1978 Fed. Rep. of Germany ..... 123/436

2042772 9/1980 United Kingdom ..... 123/436

*Primary Examiner*—Tony M. Argenbright

*Attorney, Agent, or Firm*—Martin A. Farber

[57] ABSTRACT

An electric device for eliminating the jerking of vehicles, particularly automotive vehicles with internal combustion engines and with a control member which influences the intake thereof, and particularly idle-speed intake measures are taken in order for the jerk speed of rotation to run through automatically, that is it cannot be continuously set by the driver by any position of the gas pedal. For this purpose there are provided means for detecting the actual speed of rotation, means for comparing the actual speed of rotation with the set jerk speed of rotation as well as limiting means for producing a signal within a predetermined rotary speed range, which signal controls the control member, within which rotary range is the jerk speed of rotation. These means are developed such that the control member causes an intake which increases with the actual speed of rotation, within the critical speed of rotation range.

5 Claims, 2 Drawing Figures

ELECTRIC DEVICE FOR ELIMINATING THE JERKING OF VEHICLES

BACKGROUND OF THE INVENTION

The present invention relates to an electric device for eliminating the jerking of vehicles, particularly automotive vehicles with internal combustion engines and with a control member which influences the intake thereof, and particularly controls the idling intake.

In some automotive vehicles having an internal combustion engine, jerking, the cause of which has not been fully clarified, occurs when traveling at constant low speed in first or second gear. This jerking is not identical with the so-called bonanza effect in which the jerking is increased upon the inciting oscillation by the driver through improper actuation of the gas pedal. In contradistinction hereto, the rhythmic surges in torque which are to be eliminated in accordance with the invention are not caused by feedback via the position of the gas pedal but by unclarified interrelationships of intake, gasoline mixing or proportioning, ignition timing and possibly other factors. A typical jerk speed of rotation for a given six-cylinder engine is 1200 rpm.

In order to eliminate the jerking it has been contemplated to make use of a known control device for the idle speed of rotation by which the idle intake is varied in opposite phase to the deviation from the desired idle speed of rotation. Such known idle intake controls are provided in order to establish the lowest possible speed of rotation with favorable consumption and emission values and to maintain said speed constant, as closely as possible around the desired idle speed of rotation, regardless of the load resulting from additional units operated by the engine as well as regardless of other variables. For this purpose, in detail, a throttle element for instance a piston, is placed in a bypass to the intake passage of the engine, the piston being displaced by a servomotor which is fed from a differential amplifier. One input of the differential amplifier is acted on by an electric variable which corresponds to the desired idle speed of rotation while a second input of the differential amplifier is connected to a speed-of-rotation transmitter. Corresponding to the difference between the actual speed of rotation and the desired idle speed of rotation, the differential amplifier produces an electric output signal which actuates the servomotor in such a manner that the deviation in the speed of rotation is reduced.

Such conventional idle intake controls have proven insufficient for eliminating the above-described jerking. They cannot balance out, in opposite phase, the rhythmic fluctuations in the speed of rotation, in particular because of the dead time of an internal combustion engine. This is also true for unsatisfactory running attempts which have been carried out with an ignition timing point shifting which operates practically without delay and without dead time. The electric control devices for maintaining the speed of the vehicle constant, which are also known from the prior art, are even less suitable for eliminating the jerking than the idle-speed intake controllers, particularly for the reason that relatively small changes in adjustment variables can cause relatively large changes in the torque of the internal combustion engine.

The object of the present invention is, therefore, to develop an electric device of the type indicated in the introductory paragraph in such a manner that by means thereof the jerking can be eliminated or avoided as far as possible, without disturbing side effects.

SUMMARY OF THE INVENTION

This objective is achieved by the invention in the manner that means for determining the actual speed of rotation of the engine, means for comparing the actual speed of rotation of the engine with a set jerk speed of rotation, as well as limiting means for producing a signal which controls the control member within a predetermined range of speeds of rotation within which the jerk speed of rotation lies are developed such that the control member causes an intake which increases with the actual speed of rotation within the speed-of-rotation range.

With this device, when the internal combustion engine reaches a predetermined range of speeds of rotation within which the jerk speed of rotation lies, more or less matter (intake air and/or fuel) which influences the intake is fed automatically to the engine depending on whether the speed of rotation is approaching, with increasing or decreasing tendency, the range in which the jerk speed of rotation lies. The device preferably controls additional matter (intake air and/or fuel) influencing the intake proportionally with an increase in the speed of rotation. In this way, the result is obtained that the jerk speed of rotation is automatically eliminated, i.e. without any intentional action on the part of the driver.

It has been found particularly advantageous to automatically run through a range of speeds of rotation of plus/minus 100 rpm around the jerk speed of rotation without the driver having the impression that the vehicle is accelerating by itself. It is intended, in this way merely to make maintaining the critical jerk speed of rotation considerably more difficult. The matter (intake air and/or fuel) for controlling the intake which is made available in larger or smaller quantities by the device is preferably air or auxiliary air.

In order to produce the device for eliminating the jerking, one may use, to particular advantage, an idle-speed intake controller which is developed, with only a few components, for the production of an additional signal, and which has a device with a voltage transmitter which is dependent on the actual speed of rotation and an electromagnetic idle-speed control member, said device being such that as means for comparing the actual speed of rotation with the jerk speed of rotation and as limiting means there is provided a differential amplifier (10), one feedback input (11) of which is connected to the voltage transmitter (speed-of-rotation to voltage converter 2), the other input (14) of which is set with a constant voltage in accordance with the jerk speed of rotation, and the output of which is fed to the idle control member (6).

Specifically, by the additional differential amplifier which exerts a limiting action at the limits of a range of speeds of rotation within which the jerk speed of rotation lies, when the speed-of-rotation range is reached, a voltage surge automatically runs through which acts via a current-voltage converter on the idle-speed control member. The range of the jerk speed of rotation is adjusted within the range of speeds of rotation at one of the two inputs of the differential amplifier, for example by a voltage divider. The combination with the idle-speed intake control, the speed of rotation of the engine can be automatically run through within the range of speeds of rotation within which the jerk speed of rotation lies, in such a manner that the driver does not have the impression that the vehicle is accelerating by itself. The maintenance of the critical speed of rotation, namely the jerk speed of rotation, is merely made considerably more difficult, since the speed of rotation "drifts" within this range. By use of the idle intake control, the critical range of speeds of rotation can be passed through exactly within the predetermined limits, which lie relatively close to each other.

In principle, it is also conceivable to establish the device for eliminating the jerking by development of a vehicle controller with which the speed of the vehicle is maintained constant or with an electronic device for controlling the position of the throttle valve, a so-called E-gas, but in this case there is not obtained the advantage of the particularly sensitive action on the controlled throughput of matter (auxiliary air) which is automatically established in combination with the idle intake controller.

Furthermore, in accordance with the invention, the voltage transmitter, which is dependent on the actual speed of rotation (speed-of-rotation voltage converter 2), and the electromagnetic idle control member (6) are components of an idle controller.

A particularly suitable sizing of the electric device for eliminating the jerking is to limit the predetermined range of speeds of rotation to plus/minus 100 rpm around the jerk speed of rotation and within this range to change the throughput of matter through the member which controls the intake by about 3 kg/hour. In this way, the range of speeds of rotation of, for example, 1100 rpm to 1300 rpm is automatically passed through in such a manner that one does not have the impression that there is an unintended acceleration of the vehicle.

BRIEF DESCRIPTION OF THE DRAWINGS

With the above and other objects in view the invention will be described by way of a preferred embodiment as an example only with reference to the drawing, of which.

DETAILED DESCRIPTION OF THE PREFERRED EMBODIMENT

Figure 1:
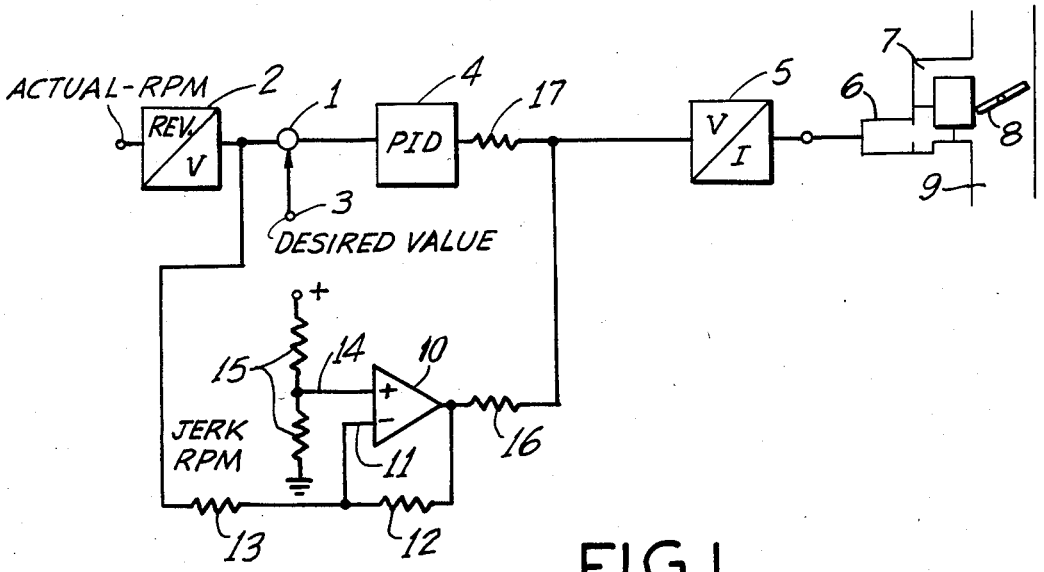
FIG. 1 is a block diagram of the device in combination with an idle intake controller.

Referring now to the drawing, FIG. 1 shows an electric idle intake control supplemented by the device for eliminating the jerking. The rectangular boxes in the figures represent resistors.

The idle speed admission controller comprises a comparison point 1 in which an actual speed of rotation value which is given off by the speed of rotation to voltage (rpm to voltage) converter 2 is compared with the desired speed of rotation, of an electric voltage at a terminal 3. The desired speed of rotation is set at a relatively low value less than 1000 rpm. In the direction of flow behind the comparison point 1 there is a control amplifier 4 with time members for the production of a PID (proportional-integral-differential) characteristic. On the output side the control amplifier is connected via a voltage to current converter 5 to an electromagnetic idle control member 6. The idle control member 6 is arranged in a bypass 7 to a throttle valve 8 within an intake passage 9 of an engine of a vehicle.

The device for eliminating the jerking comprises essentially a differential amplifier 10, a first input of which is a feedback over a resistor 12 and a resistor 13 which is connected with the output of the speed of rotation voltage converter 2.

A voltage corresponding to the jerk speed of rotation is set by a voltage divider 15 and applied to a second input 14 of the differential amplifier 10. Coupling resistors 16 and 17 couple the differential amplifier to the output of the control amplifier.

Figure 2:
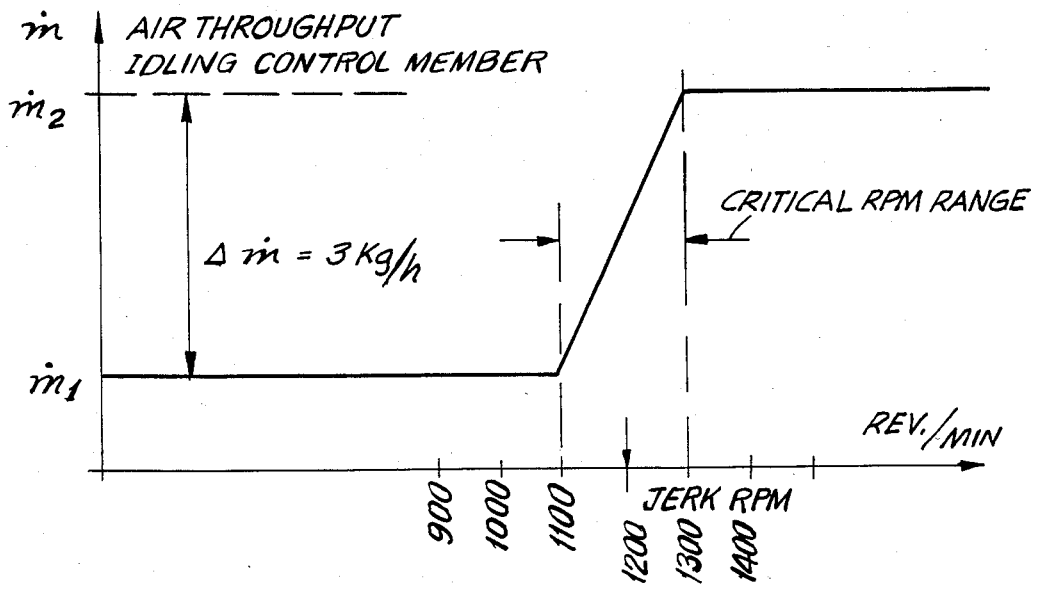
FIG. 2 is a diagram of the additional air throughput controlled thereby as a function of the speed of rotation.

The action of the arrangement in accordance with FIG. 1 will be discussed in connection with FIG. 2 which shows the dependency of the air throughput in the bypass 7 as a function of the engine speed of rotation. It can be seen from FIG. 2 that here the jerk speed of rotation is 1200 rpm and the critical length of speed of rotation to which the device is set by the limiting action of the differential amplifier 10 extends from 1100 to 1300 rpm.

In the idle intake device of FIG. 1 variations in the speed of rotation of the internal combustion engine are counteracted in a conventional manner by formation of a comparison at the comparison point 1, amplification and formation of the intended time functions in the control amplifier 4 and conversion of the output voltage of the control amplifier within the voltage current converter 5 in opposed phase by means of the idle control member 6. In this connection the additional device for avoiding the jerking with the differential amplifier 10 as an active element is normally without action since the amplifier does not amplify outside the region of the input voltage difference at its terminals 11 and 14. The air throughput at a lower speed of rotation outside the critical range of speeds of rotation amounts, for instance to $\dot{m}1$ and is determined by the control amplifier 4. However, as soon as the voltage differential value at the inputs 11 and 14 of the differential amplifier 10 reaches the control range thereof, a voltage surge is produced at the output of this feedback differential amplifier and is superimposed on the output value of the control amplifier 4 and by means of the idle control member causes an additional throughput which increases continuously with increasing speed of rotation within the range of critical speeds of rotation. In this way the additional throughput $\dot{m}2$ is obtained and remains constant upon increasing speed of rotation as a result of the limiting effect of the differential amplifier. If, on the other hand, the upper speed of rotation drops from higher values to the critical region, then the differential amplifier 10 automatically sets back the voltage surge so that the throughput drops continuously with decreasing speed of rotation from $\dot{m}2$ to $\dot{m}1$ and remains constant again below this value.

In this way, even in case of involuntary actuation of the gas pedal by the driver in order to maintain the engine speed of rotation constant, it is practically impossible to reach the jerk speed of rotation except during the automatic passage through this range of speeds of rotation by the additional device provided. The jerk speed of rotation will therefore not constitute a disturbance for the driver.

While I have disclosed one embodiment of the invention, it is to be understood that this embodiment is given by example only and not in a limiting sense.

I claim:

1. An electric device for eliminating the jerking of vehicles, particularly automotive vehicles, with internal combustion engine and with a control member which controls the intake thereof, particularly the idling intake, comprising means for determining the actual speed of rotation of the engine, first means for comparing said actual speed of rotation to a desired speed of rotation, second means for comparing the actual speed of rotation of the engine with a set jerk speed of rotation, means coupled to an output terminal of said second comparing means for producing a drive signal, control amplifier means connected to an output terminal of said first comparing means for combining an output signal of said first comparing means with the signal of said drive signal means for driving the control member within a predetermined range of speeds of rotation within which the jerk speed of rotation lies, and wherein said drive-signal means operates the control member to produce an intake which increases with the actual speed of rotation within said speed-of-rotation range.

2. The device according to claim 1, wherein said means for determining the actual speed of rotation of the engine includes a voltage transmitter providing a voltage dependent on the actual speed of rotation, and wherein said drive-signal means is provided as a differential amplifier having one feedback input connected to the voltage transmitter, another input set with a constant voltage in accordance with the jerk speed of rotation, and an output fed to the control member.

3. The device according to claim 2, wherein the control member is an electromagnetic idle control member, and said voltage transmitter, the output of which is dependent on the actual speed of rotation, and the electromagnetic idle control member serve to control the idle of the engine.

4. The device according to claim 1, wherein the predetermined range of speeds of rotation is limited to plus/minus 100 rpm around the jerk speed of rotation.

5. The device according to claim 4, wherein within the predetermined range of speeds of rotation, the throughput of material through the control member which controls the intake changes by about 3 kg/hour.

* * * * *